United States Patent [19]

Rangaswamy et al.

[11] Patent Number: 4,599,270

[45] Date of Patent: Jul. 8, 1986

[54] ZIRCONIUM OXIDE POWDER CONTAINING CERIUM OXIDE AND YTTRIUM OXIDE

[75] Inventors: Subramaniam Rangaswamy, Port Jefferson Station; John H. Harrington, Warwick, both of N.Y.

[73] Assignee: The Perkin-Elmer Corporation, Norwalk, Conn.

[21] Appl. No.: 606,024

[22] Filed: May 2, 1984

[51] Int. Cl.[4] ..... B05D 1/08

[52] U.S. Cl. ..... 428/402; 428/697; 427/423; 501/152; 501/103

[58] Field of Search ..... 501/152, 103; 427/423, 427/34; 428/402, 697

[56] References Cited

U.S. PATENT DOCUMENTS

| | | | |
|---|---|---|---|
| 3,322,515 | 5/1967 | Dittrich et al. | 427/423 |
| 3,501,097 | 3/1970 | Daley | 239/85 |
| 3,617,358 | 11/1971 | Dittrich | 427/423 |
| 4,132,916 | 1/1979 | Hueschen et al. | 427/34 X |
| 4,248,940 | 2/1981 | Goward et al. | 427/423 X |
| 4,299,859 | 11/1981 | Romine | 427/34 |
| 4,328,285 | 5/1982 | Siemers et al. | 427/190 |
| 4,421,799 | 12/1983 | Novinski | 427/423 |
| 4,450,184 | 5/1984 | Longo et al. | 428/402 X |

FOREIGN PATENT DOCUMENTS

| | | | |
|---|---|---|---|
| 306106 | 6/1971 | U.S.S.R. | 501/103 |

OTHER PUBLICATIONS

"Flash Method of Determining Thermal Diffusivity, Heat Capacity and Thermal Conductivity", Journal of Applied Physics, vol. 32, #9, 9/1961, pp. 1679–1684.

*Primary Examiner*—Shrive P. Beck

*Attorney, Agent, or Firm*—H. S. Ingham; F. L. Masselle; E. T. Grimes

[57] ABSTRACT

A flame spray material for producing a low thermal conductivity ceramic coating is comprised of a homogeneous ceramic composition formed of zirconium oxide, cerium oxide and yttrium oxide. The composition is preferably in the form of composite particles each of which contains a plurality of subparticles of each of the oxide constituents bonded with an organic binder.

8 Claims, No Drawings

ZIRCONIUM OXIDE POWDER CONTAINING CERIUM OXIDE AND YTTRIUM OXIDE

This invention relates to a flame spray zirconium oxide material which will produce coatings characterized by low thermal conductivity, and to a process of flame spraying such coatings.

BACKGROUND OF THE INVENTION

Flame spraying involves the heat softening of a heat fusible material, such as a metal or ceramic, and propelling the softened material in particulate form against a surface which is to be coated. The heated particles strike the surface and bond thereto. A conventional flame spray gun is used for the purpose of both heating and propelling the particles. In one type of flame spray gun, the heat fusible material is supplied to the gun in powder form. Such powders are typically comprised of small particles, e.g., below 100 mesh U.S. standard Screen size to about 5 microns.

A flame spray gun normally utilizes a combustion or plasma flame to produce the heat for melting of the powder particles. It is recognized by those of skill in the art, however, that other heating means may be used as well, such as electric arcs, resistance heaters or induction heaters, and these may be used alone or in combination with other forms of heaters. In a powder-type combustion flame spray gun, the carrier gas for the powder can be one of the combustion gases or an inert gas such as nitrogen, or it can be simply compressed air. In a plasma spray gun, the primary plasma gas is generally nitrogen or argon. Hydrogen or helium is usually added to the primary gas. The carrier gas is generally the same as the primary plasma gas, although other gases, such as hydrocarbons, may be used in certain situations.

The material alternatively may be fed into a heating zone in the form of a rod or wire. In the wire type flame spray gun, the rod or wire of the material to be sprayed is fed into the heating zone formed by a flame of some type, where it is melted or at least heat-softened and atomized, usually by blast gas, and thence propelled in finely divided form onto the surface to be coated. The rod or wire may be conventionally formed as by drawing, or may be formed by sintering together finely divided material, or by bonding together finely divided material by means of an organic binder or other suitable binder which disintegrates in the heat of the heating zone, thereby releasing the material to be sprayed in finely divided form.

Flame sprayed ceramic coatings containing refractories such as zirconium oxide are often used for thermal barrier protection of metal components, such as in gas turbine engines. The zirconium oxide may contain some hafnium oxide and incidental impurities. It typically is stabilized with calcium oxide or yttrium oxide or may be in the form of magnesium zirconate. Yttrium oxide is a preferable stabilizer because it renders long term stability at high temperatures. Such zirconium oxide coatings are generally used for thermal barrier purposes such as in gas turbine engines, requiring low thermal conductivity as well as resistance to thermal shock, hot corrosion and erosion.

Flame sprayed ceramic coatings usually are not fully dense, having some porosity typically up to about 20% depending on composition, powder size distribution, flame spray method and parameters. A higher porosity generally contributes to lower thermal conductivity and a higher degree of resistance to thermal stress than the denser coatings. However, a more porous coating will have lower resistance to corrosion and erosion and other wear conditions that exist in the environments where such coatings are used.

U.S. Pat. No. 4,328,285 describes plasma spraying spherical agglomerate particles formed by spray drying a two component powder of zironium oxide and at least 15% cerium oxide particles. An example teaches 26% cerium oxide. The patent is directed to improved resistance at elevated temperatures to vanadium impurities often present in turbine fuels. In this regard yttrium oxide is considered to be detrimental, and the patent explicitly excludes yttrium oxide as well as calcium oxide from the composition of the spray powder.

In view of the foregoing, it is a primary object of the present invention to provide a novel flame spray material for producing a ceramic coating characterized by low thermal conductivity.

It is another object of this invention to provide a novel flame spray material for producing a ceramic coating that has the combined properties of low thermal conductivity and high resistance to thermal shock, hot corrosion and erosion.

A further object of this invention is to provide an improved flame spray process for producing a ceramic coating characterized by low thermal conductivity.

BRIEF DESCRIPTION OF THE INVENTION

The foregoing and other objects of the present invention are achieved by a flame spray material for producing a ceramic coating characterized by low thermal conductivity. The flame spray material according to the present invention comprises a homogeneous composition of zirconium oxide, cerium oxide, yttrium oxide and, optionally, a binder.

DETAILED DESCRIPTION OF THE INVENTION

According to the present invention, a ceramic composition has been developed for flame spraying onto substrates by conventional flame spray equipment. The coating produced by the flame spraying of the novel ceramic composition has low thermal conductivity compared to prior art flame sprayed ceramic coatings. Dense coatings of the composition also have excellent resistance to erosion, hot corrosion and thermal shock.

The flame spray material comprises a homogeneous ceramic composition consisting of zirconium oxide, cerium oxide, yttrium oxide, and optionally a binder in an amount up to about 10 percent. The cerium oxide is present in an amount between about 23 and 29 percent and preferably about 26 percent by weight of the total of the zirconium oxide and cerium oxide. The yttrium oxide is present in an amount between about 1 and 4 percent and preferably between about 2 and 3 percent by weight of the total of the zirconium oxide, yttrium oxide and cerium oxide. It is important that the yttrium oxide not exceed about 4 percent, as it has been found that higher amounts result in inferior coatings that are soft and weak.

The flame spray material may be in any form that is suitable for flame spraying such as a rod but is preferably in the form of a powder. The powder should have conventional size limits, generally between about −100 mesh (U.S. standard screen size) and +5 microns and preferably between about −200 mesh and +25 microns.

As used herein in respect to the flame spray material, the term "homogeneous" means that there is a plurality of subparticles of each of the individual oxide constituents forming the structure of the ceramic composition, the subparticles being less than 25 microns in size and preferably less than 10 microns. The subparticles of each of the individual oxide constituents preferably have sizes within the same order of magnitude of each other. In one embodiment the constituents may be fully in solution together on a molecular scale. Where the flame spray material is a powder, the subparticles of the individual constituents are substantially smaller than the average size of the powder particles, for example, less than one-third of the size.

It is speculated that the reason for the requirement that the composition be homogeneous is that the crystalline structures in the flame sprayed ceramic coatings are influence critically by the chemical compositions on a microscopic or even molecular scale and, therefore, the coating compositions on such a scale should contain significant amounts of all the oxide constituents in solution. For example, where a powder is formed by merely bonding at least one of the constituents onto the surfaces of individual larger core particles of another constituent to form a powder of clad particles, which powder is not homogeneous in accordance with the present invention, the constituent clad on the surface apparently does not sufficiently diffuse into the core particle during flame spraying.

The homogeneous ceramic composition may be formed by any known or desired method. For example, the powder may be made by the conventional method of fusing or sintering together the three constituent oxides, and then crushing and screening the fused product to form powder of the proper size. Another alternative is to combine and sinter subparticles of cerium oxide and subparticles of zirconium oxide that are previously and conventionally stabilized with yttrium oxide. Yet another approach is to initially fuse zirconium oxide and cerium oxide and combine subparticles of this with subparticles of yttrium oxide. A preferred method is to fabricate the powder in the form of composite particles each of which contains a plurality of subparticles of each of the three oxide constituents bonded with a binder, preferably an organic binder, which may be present in an amount up to 10 percent and preferably at least 0.2 percent by weight. Such powder may be produced, for example, by a spray drier process such as described in U.S. Pat. No. 3,617,358. Any known or desired binder such as listed in that referenced patent may be used. Generally the organic binder will burn or evaporate from the material in the heat of the flame spray process resulting in a coating which is free of the binder constituents and has the desired characteristic of thermal shock resistance.

Another method for preparing the powder is to form composite particles with a spray drier as above, feed the particles through a zone of high temperature to fuse the particles, allow the particles to cool and solidify individually, and collect the powder particles so formed. The zone of high temperature may be created with an induction plasma, a plasma spray gun through which the powder may be fed in the ordinary manner, or the like. The powder collected is comprised of solid, fused, substantially spherical particles that are homogeneous in accordance with the present invention.

The zirconium oxide constituent may be used in its unstabilized form, or, as described above, may have been previously stabilized with the yttrium oxide or the cerium oxide. Also, unless highly purified, zirconium oxide typically may contain a small proportion of hafnium oxide which has similar physical and chemical characteristics and, except for certain nuclear applications, does not substantially change the physical characteristics of coatings. Hafnium oxide may be present, for example, in an amount up to about 10 percent by weight of the total of the zirconium oxide and hafnium oxide. The term "zirconium oxide" as used herein and in the claims is intended to include zirconium oxide that may contain such a proportion of hafnium oxide.

While the homogeneous ceramic composition of the present invention preferably is used as is, the same optionally may be combined with other flame spray materials such as another ceramic composition or a metal. For example, where the material is a powder the homogeneous ceramic composition may be blended with another flame spray ceramic powder having desired characteristics such a wear resistance, for example aluminum oxide. A flame sprayed coating of such a powder blend will have the combined properties of erosion resistance and thermal shock resistance. Where the second powder is a metal the ceramic coating will be a cermet with properties enhanced by the metal.

The coatings according to the present invention may be used wherever it is desirable to form a thermally insulating barrier to protect a surface against the effects of high temperature, especially where conditions for erosion, hot corrosion or thermal shock are also present. Typical applications include gas turbine burner cans, shrouds and other turbine engine components. Other areas are rocket thrust chambers and nozzles, furnace chambers and stacks, fluid bed coal gasifiers, power plant heating surfaces, and piston domes, cylinder heads and cylinder walls of internal combustion engines, especially adiabatic diesel engines.

Coatings of the present invention also have sliding wear characteristics and may be used, for example, on piston ring surfaces.

EXAMPLE 1

A 8189 gram quantity of zirconium oxide ($ZrO_2$) powder, of particle size less than 10 microns and approximately 3 microns average, was blended with 284 grams of yttrium oxide ($Y_2O_3$) powder of size less than 5 microns and approximately 1 micron average, and 2877 grams of cerium oxide ($CeO_2$) of size 1 to 5 microns. A binder of sodium carboxyl methyl cellulose was dissolved in water to form a concentrated solution containing 113.5 grams of binder and 4653.5 grams of water.

A slip was formulated according to the following table, using the prepared concentrations described above, where applicable, and in the proportions indicated:

TABLE I

| Total Added | Addition | Wt. Solids | Wt. Liquid |
|---|---|---|---|
| 11,350 g | Ceramic Blend | 11,350 g | |
| 1,135 g | Binder solution at 10% | 113.5 g solids | 1,021.5 g |
| 3,632 g | Water | | 3,632 g |

In blending the ingredients to form the slip, all liquids and solutions were first weighed into the mixing tank with the mixer running. The dry powder was then fed into the mixing tank such that deflocculation occurred immediately, and after a short mixing time, the slip was uniform in consistency. The slip was spray dried as described in U.S. Pat. No. 3,617,358. Heated air was introduced in a cyclonic flow pattern at the top of a vertical straight-cylindrical drying chamber. The slip was atomized and directed upwards along the vertical centerline by a blast of compressed air.

The slip was fed by pumping into the atomizing nozzle from which the atomized slip was propelled through the drying chamber, to be finally collected in chamber and cyclone collectors as a dry powder. The powder collected in the spray dryer chamber was screened with a 200 mesh screen to yield a free flowing powder having a size in the range −200 mesh to +25 microns. The composition was, by weight, 72.2 per cent zirconium oxide, 25.3 percent cerium oxide, and 2.5 percent yttrium oxide based on the total of the oxides. The cerium oxide was 26 percent of the total of the zirconium oxide and cerium oxide.

The powder was flame sprayed with a standard plasma flame spray gun of the general type described in U.S. Pat. No. 3,145,287 and sold by METCO Inc., Westbury, N.Y., under the trademark METCO Type 7MB, using a GH nozzle with No. 3 powder port, and a powder feeder of the type described in U.S. Pat. No. 3,501,097 and sold under the trademark METCO Type 3MP. Parameters were argon plasma gas at 100 p.s.i. pressure and 80 CFH flow, hydrogen secondary gas at 50 p.s.i. and 15 CFH, 500 amperes, 68 volts, carrier gas 15 CFH, powder feed rate 9 pounds per hour, spray distance 3½ inches. Coating hardness averaged Rc 45. Coatings of up to about ⅛ inch thickness were sprayed onto nickel alloy substrates prepared with a bond coat of flame sprayed aluminum clad nickel alloy powder as described in U.S. Pat. No. 3,322,515. Metallographic examinations of the coating revealed an absence of unmelted particles and about 3 to 4 percent porosity.

EXAMPLE 2

The process of Example 1 was repeated except the proportions of the oxide powders were adjusted to yield a composite powder, by weight, 70.5 percent zirconium oxide, 24.5 percent cerium oxide and 5 percent yttrium oxide, a composition outside the scope of the present invention. Coatings were flame sprayed in a similar manner, coating hardness was Rc32 and porosity about 3 to 4 percent.

EXAMPLE 3

The process of Example 1 was repeated except yttrium oxide was omitted from the composition, thus yielding a composite powder of, by weight, 74 percent zirconium oxide and 26 percent cerium oxide, a composition outside the scope of the present invention. Coatings were sprayed in a similar manner. Coating hardness was Rc37 and porosity about 5 percent.

Several coatings were prepared from commercially available powders for comparison. One such coating tested was produced with a composite powder of zirconium oxide and 20% yttrium oxide in the manner of Example 1 except without cerium oxide. The powder is sold by METCO Inc., Westbury, N.Y., under the trademark METCO 202-NS. Another commercial coating tested was from a pre-stabilized powder of zirconium oxide and 8% yttrium oxide, sold under the trademark METCO 204-NS. These commercial coatings are specified for use on certain gas turbine engine components.

The thermal conductivities of the coating of the examples and the similar commercial coatings containing no cerium oxide were measured by a recognized method utilizing a laser. Details are given in "Flash Method of Determining Thermal Diffusivity, Heat Capacity and Thermal Conductivity" by Parker et al., *Journal of Applied Physics,* Vol. 32, No. 9 (September 1961). Briefly a high-intensity short-duration light pulse is absorbed in the front surface of a thermally insulated specimen a few millimeters thick coated with camphor black, and the resulting temperature history of the rear surface is measured by a sensor and recorded with an oscilloscope and camera. The thermal diffusivity is determined by the shape of the temperature versus time curve at the rear surface, and the thermal conductivity by the product of the heat capacity, thermal diffusivity, and the density.

For thermal cycling tests, coatings were flame sprayed to about 0.75 mm thick on a nickel alloy substrate prepared with a bond coat as in Example 1. The samples were exposed to alternating impingement of a combustion flame and a jet of cold air. Results are reported as the number of cycles run, or to failure where such occurred.

Thermal shock resistance was measured on those same samples that survived the flame/air cycling. The survived samples were heated in a furnace to 1000° C. and then quenched into water at room temperature. Results are reported as cycles to failure, defined by spalling.

To determine the suitability of the coating material for use in, for example, gas turbine engines, an erosion test was developed for testing the coating. A substrate with the coating was mounted on a water cooled sample holder and a propane-oxygen burner ring surrounding an abrasive feed nozzle was located to impinge on the sample. A −270 mesh to +15 micron aluminum oxide abrasive was fed through a nozzle having a diameter of 4.9 mm with a compressed air carrier gas at 3 l/sec flow to produce a steady rate of abrasive delivery. The flame from the burner produced a surface temperature of approximately 980° C. The results of this test are expressed as coating volume loss per unit time.

Results of the several tests are given in Table II.

TABLE II

| | Example 1 $ZrO_2$—25.3 $CeO_2$—2.5 $Y_2O_3$ | Example 2 $ZrO_2$—24.5 $CeO_2$—5 $Y_2O_3$ | METCO 202-NS $ZrO_2$—26 $CeO_2$ | METCO 204-NS $ZrO_2$—8$Y_2O_3$ |
|---|---|---|---|---|
| Porosity | 3–4% | 3–4% | 5% | 7% |
| Thermal Conductivity (w/m °K., 25–1000° C.) | 0.85 | — | 1.37 | 1.3 |
| Flame/Air-jets (Cycles) | 500 (no failure) | 500 (no failure) | 500 (no failure) | 500 (no failure) |
| Water Quench (Cycles to failure) | 33–45 | 6 | 33 (no failure) | 15 |

TABLE II-continued

| | Example 1 $ZrO_2$—25.3 $CeO_2$—2.5 $Y_2O_3$ | Example 2 $ZrO_2$—24.5 $CeO_2$—5 $Y_2O_3$ | METCO 202-NS $ZrO_2$—26 $CeO_2$ | METCO 204-NS $ZrO_2$—8$Y_2O_3$ |
|---|---|---|---|---|
| Hot Erosion Resistance ($cm^3$ of coating loss $\times 10^{-4}$ per gram of abrasive) | 1.7 | 2.8 | 1.9 | 1.8 |

Coatings of the present invention also showed excellent resistance to a molten mixture of sodium sulphate at 750° C. for 29 hours.

While the invention has been described above in detail with reference to specific embodiments, various changes and modifications which fall within the spirit of the invention and scope of the appended claims will become apparent to those skilled in this art. The invention is therefore only intended to be limited by the appended claims or their equivalents.

What is claimed is:

1. A flame spray material characterized by ability to produce coatings having low thermal conductivity, comprising a homogeneous ceramic composition consisting of:

zirconium oxide optionally containing up to about 10 percent of hafnium oxide based on the total weight of the zirconium oxide and hafnium oxide;

cerium oxide; and yttrium oxide;

the cerium oxide being present in an amount between about 23 and 29 percent based on the total weight of the zirconium oxide, hafnium oxide and cerium oxide; and the yttrium oxide being present in an amount between about 1 and 4 percent based on the total weight of the zirconium oxide, hafnium oxide, cerium oxide and yttrium oxide.

2. Flame spray material according to claim 1 in which the homogeneous ceramic composition is in the form of powder having a size between about −100 mesh and +5 microns.

3. Flame spray material according to claim 2 in which the powder is in the form of composite particles each of which comprises a plurality of subparticles of zirconium oxide, cerium oxide and yttrium oxide, the subparticles having a size less than about 25 microns.

4. Flame spray powder according to claim 3 in which the subparticles have a size less than about 10 microns.

5. Flame spray material according to claim 3 in which the subparticles are bonded with organic binder in an amount between about 0.2 and 10 percent by weight of the composition.

6. Flame spray material according to claim 3 in which the composite particles are sintered.

7. Flame spray material according to claim 2 in which the powder is in the form of fused particles.

8. A flame spray powder having particles of size between about −200 mesh and +25 microns comprising:

subparticles of unstabilized zirconium oxide containing up to about 10 percent by weight of hafnium oxide based on the total weight of the zirconium oxide and hafnium oxide;

subparticles of cerium oxide; and subparticles of yttrium oxide;

organic binder in an amount between about 0.2 percent and 10 percent by weight of the ceramic composition;

the subparticles having a size less than about 10 microns;

the cerium oxide being present in an amount of about 26 percent by weight of the total of the zirconium oxide, hafnium oxide and cerium oxide; and the yttrium oxide being present in an amount between about 2 and 3 percent by weight of the total of the zirconium oxide, hafnium oxide, cerium oxide and yttrium oxide.

* * * * *